US005533129A

United States Patent [19]

Gefvert

[11] Patent Number: 5,533,129

[45] Date of Patent: Jul. 2, 1996

[54] MULTI-DIMENSIONAL SOUND REPRODUCTION SYSTEM

[76] Inventor: Herbert I. Gefvert, 495 S. Green Bay Rd., Lake Forest, Ill. 60045

[21] Appl. No.: 295,253

[22] Filed: Aug. 24, 1994

[51] Int. Cl.[6] ..... H04R 5/00

[52] U.S. Cl. ..... 381/24; 381/18

[58] Field of Search ..... 381/24, 27, 61, 381/87–90, 18

[56] References Cited

U.S. PATENT DOCUMENTS

| | | | |
|---|---|---|---|
| 4,051,919 | 10/1977 | Buettner | 381/24 |
| 4,133,975 | 1/1979 | Barker, III | 381/24 |
| 4,888,804 | 12/1989 | Gefvert | 381/24 |
| 5,199,075 | 3/1993 | Fosgate | 381/24 |
| 5,265,166 | 11/1993 | Madnick et al. | 381/18 |
| 5,309,518 | 5/1994 | Ickler et al. | 381/24 |

OTHER PUBLICATIONS

"Surround–sound psychoacoustics": Michel Gerzon; Mathematical Institute; Oxford University. Wireless World; Nov. 1974. Original thesis on multichannel sound beyond stereo.

"Three–Loudspeaker Stereo": Keith Howard; Audiophile; Dec. 1992.

"Surround By Sound": Peter Dolman; Wireless World; Dec. 1989. Dolby Surround/ProLogic theory, circuits.

"Dolby Surround . . . A Listener's Guide": Dolby Labs; Tech. Journal Mar. 1993.

"Expanding stereo beyond the speakers": Leonard Feldman; Radio Electronics; Nov. 1990. SRS Stereo Retrieval System.

Sonic Holography: Carver Model HR–895 owner manual.

*Primary Examiner*—Stephen Brinich

*Attorney, Agent, or Firm*—Fitch, Even, Tabin & Flannery

[57] ABSTRACT

A unified loudspeaker system and method for use with a home theater stereo surround sound receiver. A plurality of binaural (dual) loudspeakers are housed in a single loudspeaker enclosure having a multiply-segmented face portion. Left and right loudspeakers are canted away from a center loudspeaker to provide more complete audio coverage of a defined listening area with audio channel separation. Six (6) equalized soundfields generated via five (5) surround sound channels from the loudspeaker enclosure configuration provide arrival times of the soundfields according to that of a live performance. Conventional two-channel stereo input sources may be combined by the system to provide desired soundfields. The preferred embodiment for a full dimensional sound field system contemplates the use of a Dolby Pro Logic AC-3 five or six channel receiver or the like as an input source. The conventional two channel stereo input sources may be combined by the system in a derived format to provide desired formats: Main Left (L), Main Right (R), Center (C), Surround Left (LS) and Surround Right (RS). A sub-woofer may also be provided.

9 Claims, 8 Drawing Sheets

MULTI-DIMENSIONAL SOUND REPRODUCTION SYSTEM

BACKGROUND OF THE INVENTION

1. Field of the Invention

The present invention relates to sound reproduction systems and more particularly to systems and methods for multi-dimensional sound reproduction utilizing multiple audio channels to generate multiple soundfields.

2. Description of the Related Art

Modern day stereo audio reproduction systems provide sound reproduction more realistic than monophonic systems because two (2) soundfields are utilized to give the listener an impression closer to that of a live performance which generates sound from multiple sources located at multiple points in space relative to the listener. However, to more truly reproduce live performances considerably more than two soundfields are needed.

In fact, sound which is heard by a listener arrives via multiple paths. Besides a direct or line of sight arrival, sound often is reflected or bounced off walls and objects prior to arriving at the listener's ears. The multiple paths from a sound source may be characterized as direct, reverberations, and indirect late arriving reverberations which may be measured with digital computing equipment. The multiple arrival of sound causes perceptibly phase shifted signals at the listener which tends to compress the soundfield.

Basic problems are associated with conventional stereo recording and reproduction equipment which tends to cause sound to be focussed and compressed. Since microphones pick up sound from single points in space, they tend to compress recorded sounds around a point. On the other hand, when speakers reproduce sound, they tend to highly focus sound in a single direction forward and away from the speaker. This accounts for the basic problem of limited and unnatural coverage associated with conventional stereo.

Over the past several years, numerous formats utilizing considerably more than two channels have been developed for more realistic spatial sound reproduction, sometimes referred to as three-dimensional or surround sound reproduction systems. Such systems have found practical application in home theater environments. Home theater, however, has proven to be a constantly evolving technology. Practical implementation of a home theater surround sound system has thus turned out to be problematic. A standardized home theater format has not been adopted. Quite to the contrary, each of the formats developed tend to create differing sonic impressions irrespective of the particular loudspeakers utilized.

Ambisonics traces its roots to the quadraphonic sound. Quadraphonic sound, while a commercial disaster, did have elements of superiority although blemished with sonic impressions that would migrate, blurr or smear. All compact discs produced by Nimbus Records have been Ambisonic encoded for a decade. Only one microphone is used which fully covers soloists and the ambience of an orchestra where a performance is given. This microphone consists of four recording diaphragms spaced apart at 90 degrees from one anther. Although well received in Europe, Ambisonics has been slow to gain acceptance in the United States. Ambisonics was developed by the National Research and Development Council in the United Kingdom. The general thesis was authored by Michael Gerzon. Two decoders were produced by Minims and Troy in the 1970s.

The Ambisonics format preceded Dolby Surround Sound. Dolby Labs saw Ambisonics' benefits for the cinema where Dolby noise reduction technology had become a household word. By extracting difference information from the primary stereo signals (left-right), vocals were cancelled from back speakers and subwoofers. This left only non-directional, spacial information. Vocalists are dominantly monophonic. Thus, audio channels were doubled from two to four. A fifth (sum total left plus right) channel was added to anchor the vocals to the center of large video screens. Where wide aspect screens are utilized the three sound channels—left, center, right—faithfully follow the action on the screen. Dolby Surround Sound's contribution to Home Theater was the addition of time delay to rear ambience loudspeakers. Adjustable delay (19 to 90 ms) is used to preserve the audio integrity between what viewers see on the screen at close range and surround sounds of long duration arriving from behind the audience.

The Stereo Retrieval System (SRS) was developed by Arnold Klayman originally for automotive applications. SRS strives to recreate a three dimensional surround sound effect by restoring the spatial elements lost in conventional recording technology. Studies have shown that microphones record only a small fraction of what is in the near field. SRS also records "ambience"—spatial characteristics that surround the musical event. Without ambience the sonic impression is flat and colorless—"canned". Extracting ambience, equalizing with the main stereo channels then feeding it back into the stereo channels SRS creates in greater realism. It is this realism that Arnold Klayman restores in the SRS surround sound giving a 3-D sonic impression.

SUMMARY OF THE INVENTION

It is an object of the present invention to provide a multi-dimensional sound reproduction system which overcomes the various problems of the prior art by providing a universal loudspeaker enclosure system compatible for use with the various home theater formats.

It is a further object of the present invention to decode stereophonic standard right and left inputs into the five channels—main left, left ambience, center, right ambience and main right—to provide compatibility with conventional stereo systems.

As such, the present invention provides the benefits of home theater surround sound systems through the use of a universal loudspeaker system and method compatible with all contemporary sound reproduction techniques. These advantages of compatibility are realized without the need for a particularized loudspeaker system and decoder for a limiting dedicated approach, which may be accomplished in either of two ways: (1) e.g., by deriving three channels in addition to the two conventional channels in a stereo receiver; or (2) e.g., by commercially available means i.e., the Dolby Pro Logic AC-3 receiver. The Dolby Pro Logic AC-3 receiver has five self contained audio channels housed in one cabinet.

I. Two conventional plus three derived channels:

A. Conventional channels: (1) Left Main—(2) Right Main

B. Derived channels:

1. Center channel (L&R)
2. Left ambience (L&R)
3. Right ambience (R&L)

II. Dolby Pro Logic AC-3 receiver channels:

1. Right Main
2. Left Main

3. Center
4. Surround Left (LS)
5. Surround Right (RS)

These and other objects and advantages are realized by a multi-dimensional sound reproduction system for creating multiple audio soundfields in a defined listening area responsive to a plurality of signals. Multi-dimensional sound reproduction is achieved with a loudspeaker enclosure having a multiply-segmented face portion having a centrally located binaural voice coil loudspeaker facing directly forward from the face portion of the enclosure into the defined listening area. A left-side located binaural voice coil loudspeaker is canted away from the centrally located loudspeaker, facing left of center forward from the face portion of said enclosure, to provide left-side audio coverage of the defined listening area with audio channel separation from said centrally located loudspeaker. A right-side located binaural voice coil loudspeaker is canted away from the centrally located loudspeaker, facing right of center forward from the face portion of said enclosure to provide right-side audio coverage of the defined listening area with audio channel separation from said centrally located loudspeaker. A network is used for receiving, combining and delivering plural signals, including means for receiving audio left channel signals, means for receiving audio right channel signals. The network derives center channel signals from a combination of the received signals. The network then delivers the derived center channel signals to the voice coils of the central loudspeaker. The network also provides means for deriving a left surround effects channel from a combination of the received signals, delivering the received left and derived left surround effects channel signals to the voice coils of the left-side loudspeakers, and means for deriving a right surround effects channel signal from a combination of the received signals, delivering said received right and derived right surround effects channel signals to the voice coils of the right-side loudspeaker.

The appended claims set for the features of the present invention with particularity. The invention, together with its objects and advantages, may be best understood from the following detailed description taken in conjunction with the accompanying drawings.

DESCRIPTION OF THE PREFERRED EMBODIMENTS

Reference will now be made in detail to the present preferred embodiments of the invention, examples of which are illustrated in the accompanying drawings. The preferred embodiment for a full dimensional sound field system contemplates the use of a Dolby Pro Logic AC-3 five or six channel receiver or the like as an input source. The conventional two channel stereo input sources may be combined by the system in a derived format to provide desired formats: Main Left (L), Main Right (R), Center (C), Surround Left (LS) and Surround Right (RS). A sub-woofer may also be provided.

Figure 1:
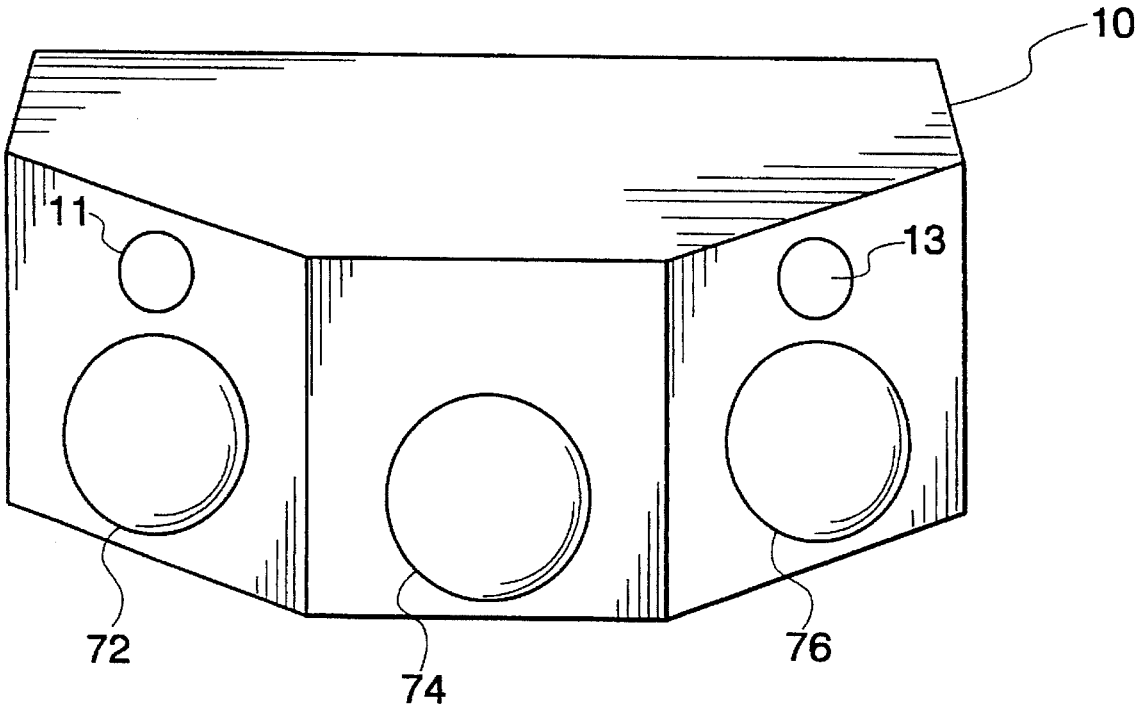
FIG. 1 is a front perspective view of the loudspeaker enclosure of the multi-dimensional sound reproduction system in accordance with the present invention.

As depicted in FIG. 1, a loudspeaker enclosure 10 embodying the multi-dimensional sound reproduction system of the present invention is shown having unitary construction advantageously allowing easy placement atop a television receiver in a home theater system. As is discussed in further detail below, three binaural (dual) loudspeakers 72, 74 and 76 are utilized to provide six (6) soundfields from five (5) home theater receiver output channels. The five channel receiver may have separate discrete outputs as under a license from Dolby, Inc., or may be derived channels from a conventional two channel stereo system. Tweeters 11 and 13 are typically provided along with left and right main speakers.

Figure 2A:
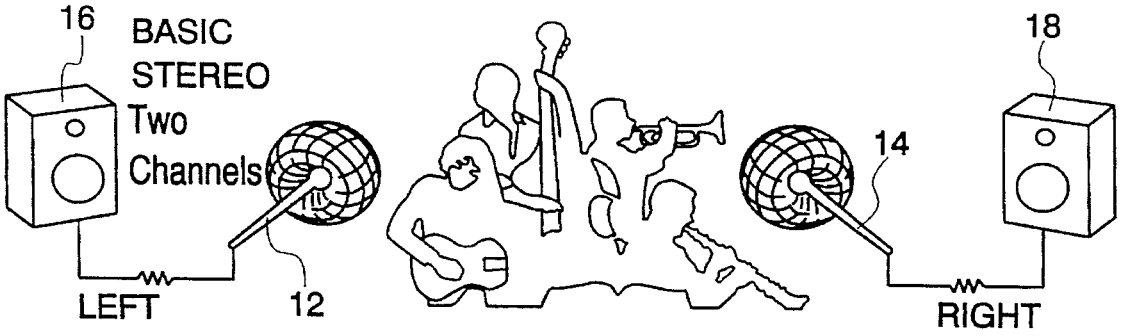
Fig. 2A PRIOR ART
FIGS. 2A–C illustrate the prior art and particularly the basic problems of soundfield compression and arrival times to listeners.
Figure 2B:
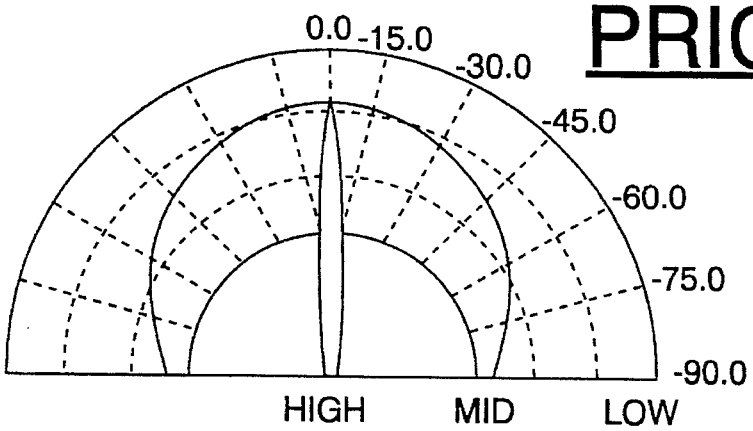
Figure 2C:
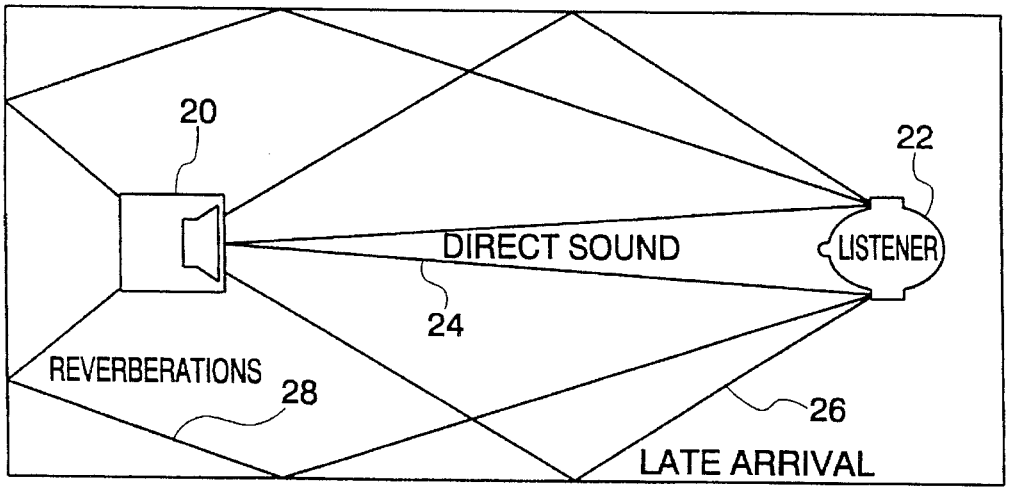
Figure 3A:
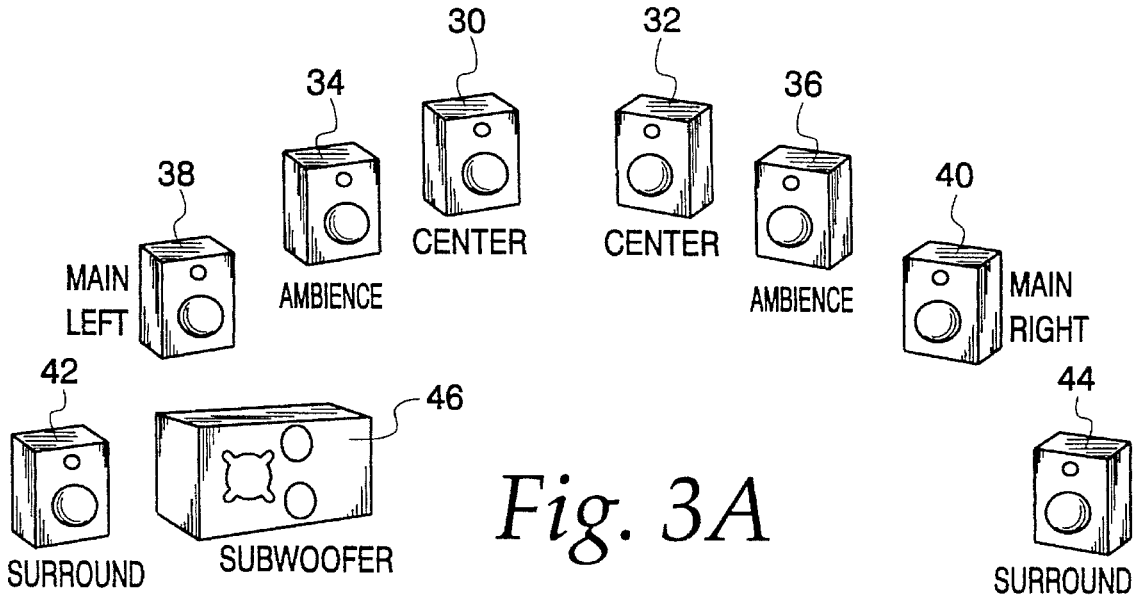
FIGS. 3A–C illustrate the concepts and configurations of the multi-dimensional sound reproduction systems.
Figure 3B:
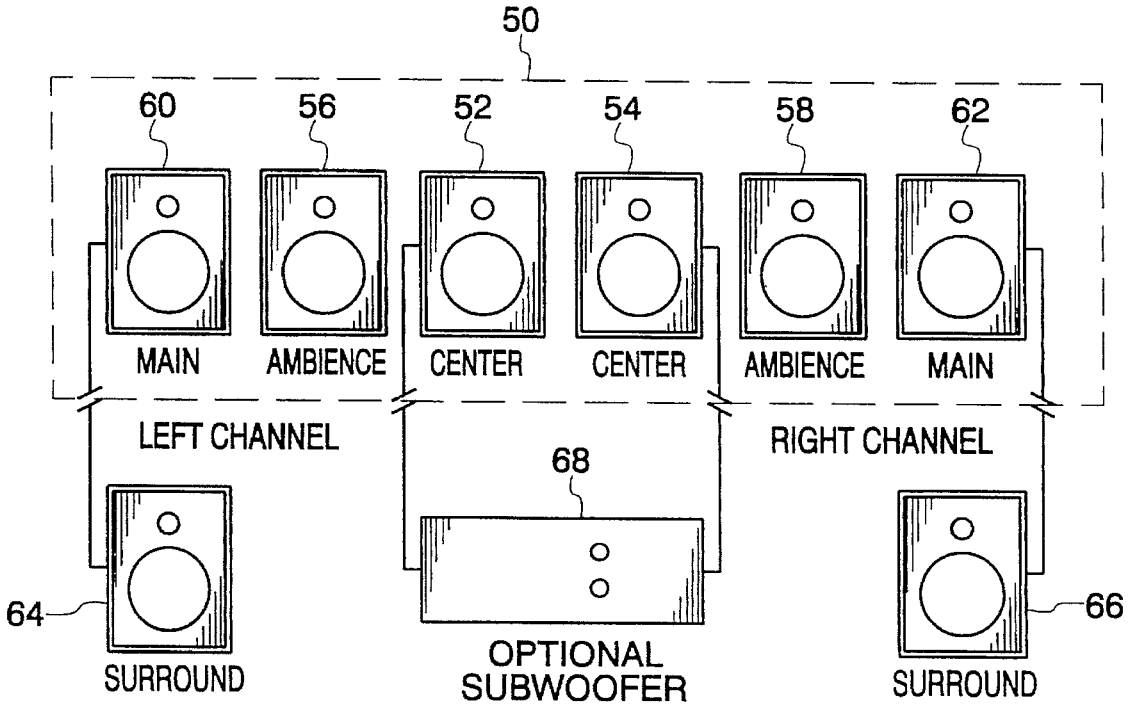
Figure 3C:
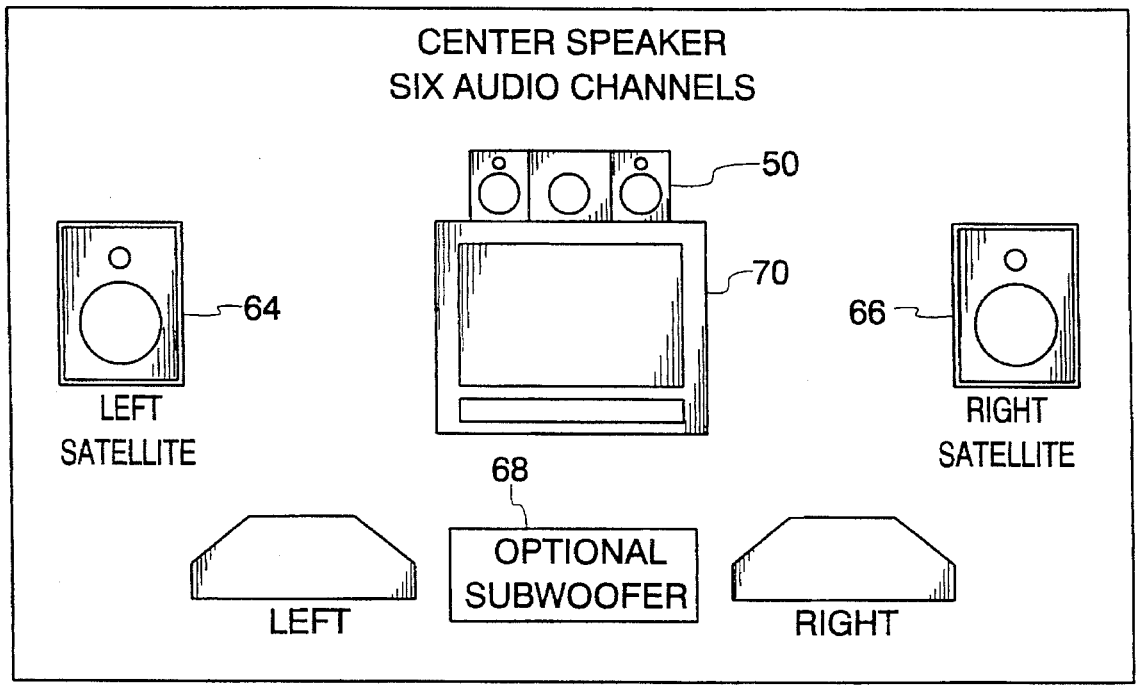

Turning now to FIGS. 2A–C, the basic problems of prior art stereo systems are illustrated therein. Performances recorded on a basic stereo (two channel) format are received at microphones 12 and 14 (see FIG. 2A). As illustrated, microphones 12 and 14 tend to receive audio around points in space. The microphones 12 and 14 also compress the sound received. Stereo sound is then reproduced via speakers 16 and 18. Speakers 16 and 18, on the other hand, provide directional sound reproduction as is illustrated by FIG. 2B. With respect to a single speaker 20, reflections arrive later than direct sounds to a listener 22. Direct sound 24 is illustrated to travel directly to the listener 22, while late arrival sounds 26 and reverberations 28 arrive at listener 22 via indirect paths. Delayed sound, however, can be detected, measured, equalized, separated and fed to discrete loudspeakers. Arrival times of reflections vary on the order of 5 to 90 milliseconds. As illustrated in FIGS. 3A–C, multiple soundfields can be created in accordance with the invention by separating direct sound from reflected sound. Feeding each to a discrete loudspeaker, loudspeakers 30, 32, 34, 36, 38, 40, 42 and 44, recreates eight (8) soundfields of the live performance. An optional subwoofer 46 increases the number of sound channels to nine (9).

An embodiment of the present invention incorporates a universal decoder in a single loudspeaker enclosure 50. The embodiment creates the basic Ambisonic, Dolby Surround Sound and Stereo Retrieval soundfields. The loudspeaker enclosure 50 provides a unified system including speakers 52, 54, 56, 58, 60 and 62. As discussed, surround satellite speakers 64 and 66, and a subwoofer 68, may also be provided. FIG. 3C illustrates position of the speakers in a home theater environment, particularly the unified loudspeaker enclosure 50 atop a television 70.

The bilateral left and right ambience voice coils utilized with the binaural loudspeakers 72, 74 and 76 supply a differential soundfield. In this embodiment the binaural loudspeakers 72, 74 and 76 are manufactured by Gefco Mfg. Co. and Advance Electric (Taiwan). The derived left ambience (L-R) and derived right ambience (R-L) signals are applied to speakers 72 and 76, respectively.

Ambience is time related. A flat direct sound on front left, center, right loudspeakers combines with non-directional ambience. It sweeps a 150° lateral arch. Ambience profoundly affects the sonic impression. Ambience relies upon the time differential from the first arrival signal to the reverberations that follow 20 to 200 milliseconds later as shown in FIG. 2C. Without ambience broadcasts and recordings have the characteristics of canned music from the 1930s—dull and lifeless.

The purpose of six (6) loudspeakers in home theater is to supply the soundstage with the correct directional paths, intensity and arrival times. The arrival times from each loudspeaker are an approximation of what would be experienced in a live performance. To provide the time differential from a single free standing speaker enclosure requires a time delay circuit as part of an audio amplifier 78.

Were space, amplifiers and funds no object, all nine (9) Virtual Reality Acoustic (VRA) channels discussed above could be implemented, each with its discrete loudspeaker, as follows:

| Left Main | Right Main | Basic Functions |
|---|---|---|
| Derived ambience left | Derived ambience right | Main left/right |
| Derived center left | Derived center right | Ambience (left minus right) |
| Derived surround left | Derived surround right | Center (left plus right) |

Figure 4A:
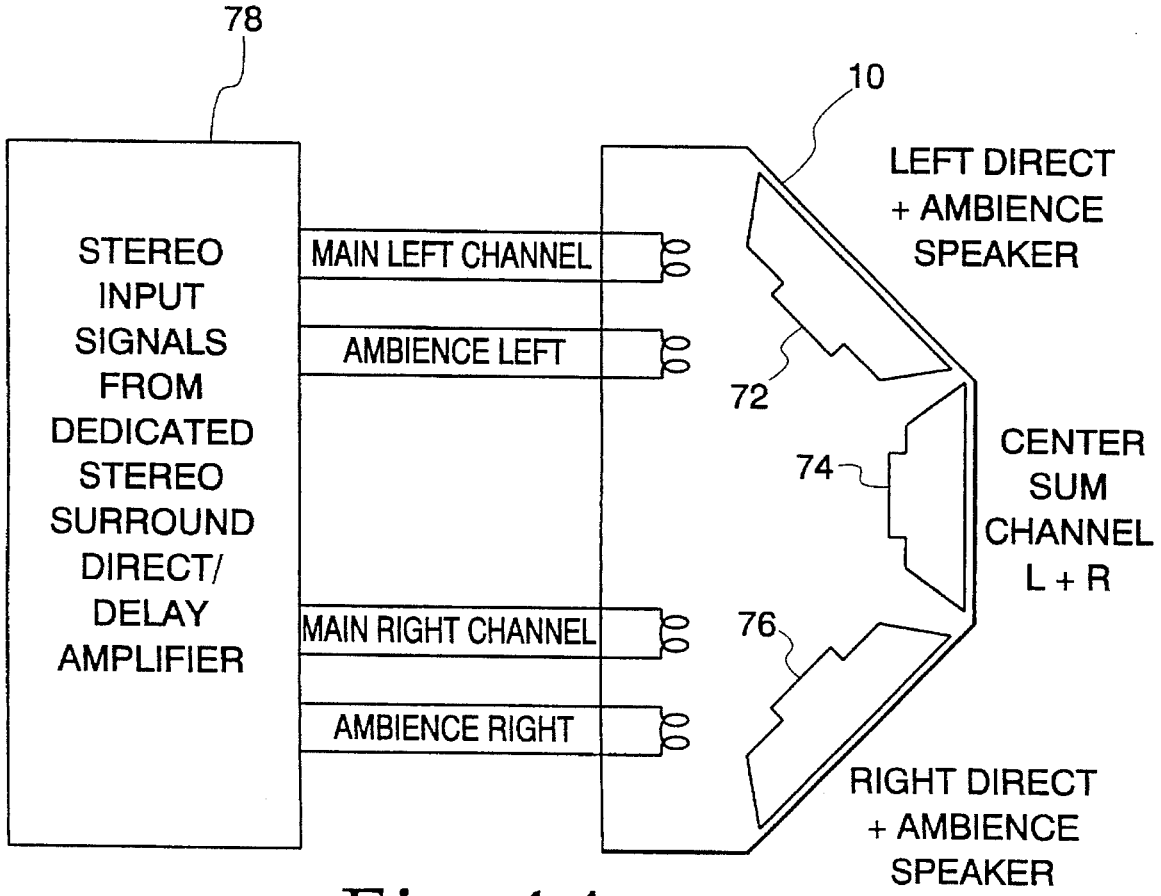
FIG. 4A is a block diagram of a sound reproduction system in accordance with the present invention.
Figure 4B:
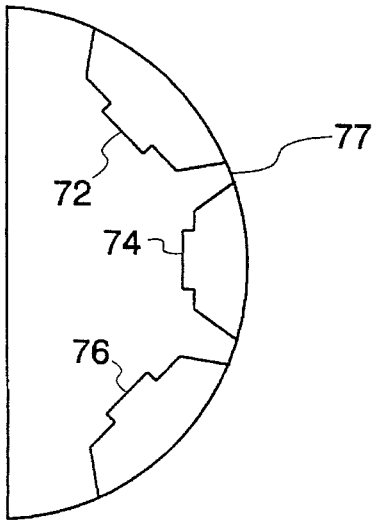
FIG. 4B shows an alternative molded enclosure or case for use in accordance with the present invention.
Figure 5A:
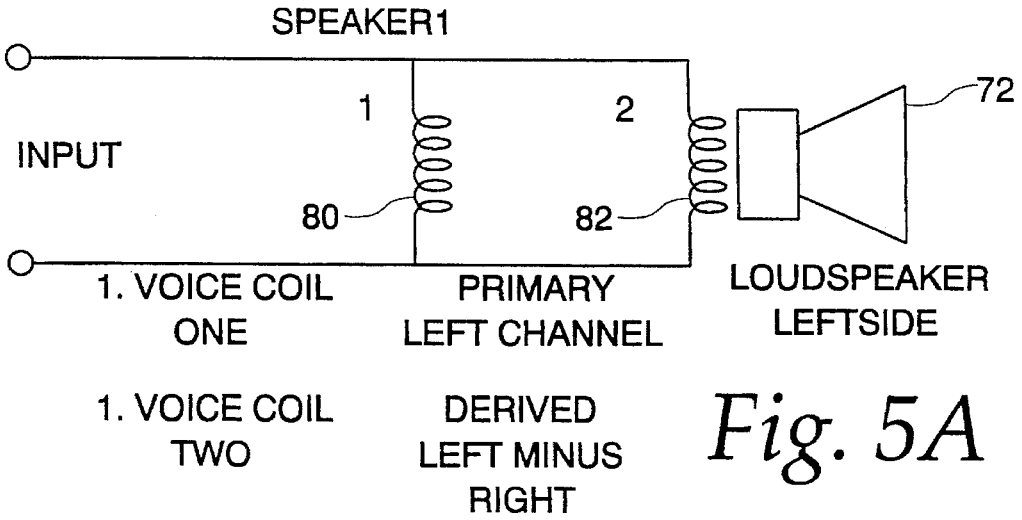
FIGS. 5A–C show input wiring to the various voice coils associated with the left, center and right binaural loudspeakers of the present invention.
Figure 5B:
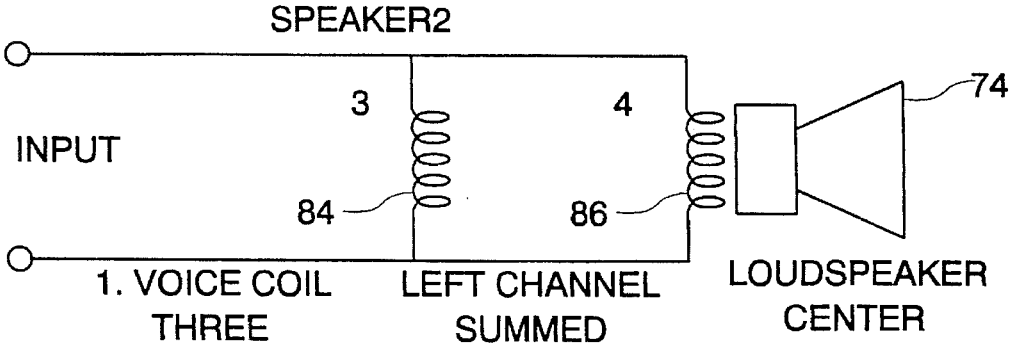
Figure 5C:
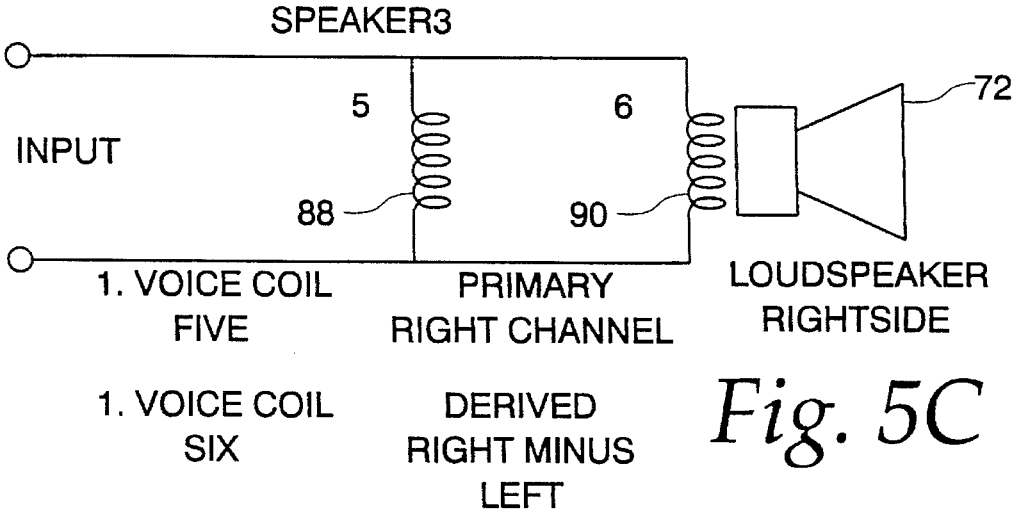

The system fully realized totals nine loudspeaker cabinets. It is an objective of the described embodiment to reduce the number of loudspeakers without sacrificing performance. To reduce the number of loudspeaker cabinets without loss in performance, the front six loudspeakers are effectively integrated into one unified enclosure, see FIGS. 1, 4A–B and 5A–C. FIG. 4B shows an alternative molded enclosure or case 77 wherein respective speakers are mounted along a curved surface. The six coils 80, 82, 84, 86, 88 and 90 of the respective binaural speakers 72, 74 and 76 provide the function equivalent to the enclosure 50 of FIGS. 3B–C, The typical home theater system may begin with a 21-inch TV picture tube and grow to large projection TV screens several feet in width. New TV screens have a wide aspect ratio thereby increasing tube width. As viewer aspect ratio increases 16×9; 24×12 lateral movement is heightened. This creates greater involvement between the audience and the action on the screen. The TV picture no longer remains flat, but envelopes the audience putting them in the center of the action. The unified loudspeaker enclosure 10 of the embodiment thus forms an indispensable part in giving the listener a 3-D music and sound experience, giving the listener improved spaciousness, directionality and 3-D imaging.

Figure 6:
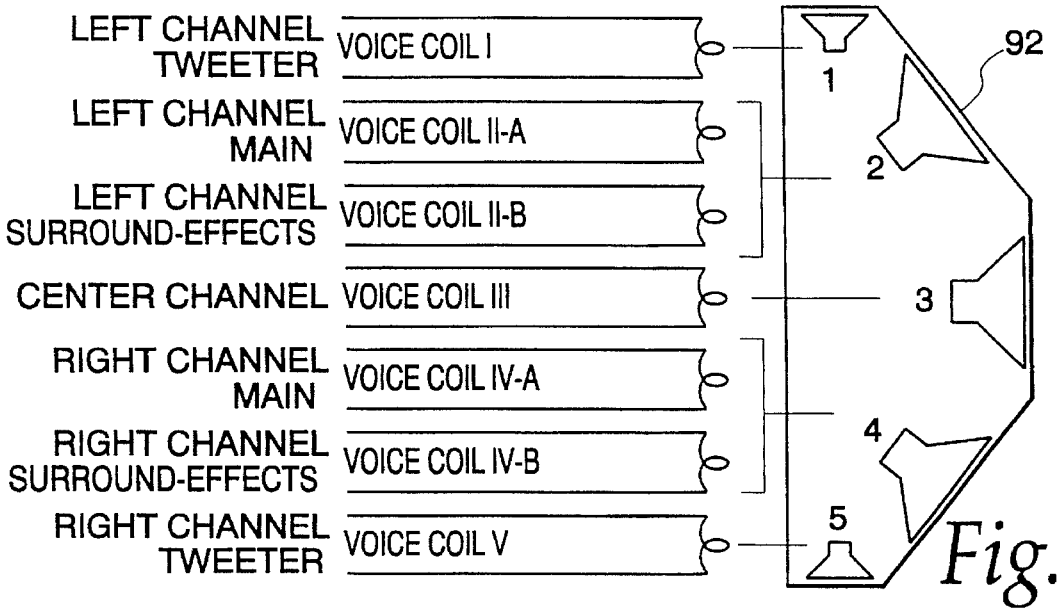
FIG. 6 illustrates an embodiment in accordance with the present invention having separate tweeter and main left and right channels, and utilizing five channels to provide six soundfields.

The preferred location for the center channel loudspeaker is atop the television 70 or on a shelf above or below the picture screen. The three main speakers 72, 74 and 76 are driven by their three dual binaural voice coils. Binaural voice coils unite six loudspeaker soundfields into three. They are combined into one cabinet to form the center channel in the system. This loudspeaker houses the main left channel, main right channel, left and right ambience channel and the center channel derived (L & R), or discrete channels from a Dolby Pro Logic AC-3 receiver. They produce six soundfields with 180° of horizontal dispersion. Tweeters are utilized to extend frequency response on the main channel wide angle speakers shown in FIG. 6 showing an alternative embodiment using an enclosure 92. To increase the width of audio system reproduction, satellite speakers are also utilized, e.g., speakers 102, 104, 106 and 108 of FIGS. 8A–B.

Figure 7A:
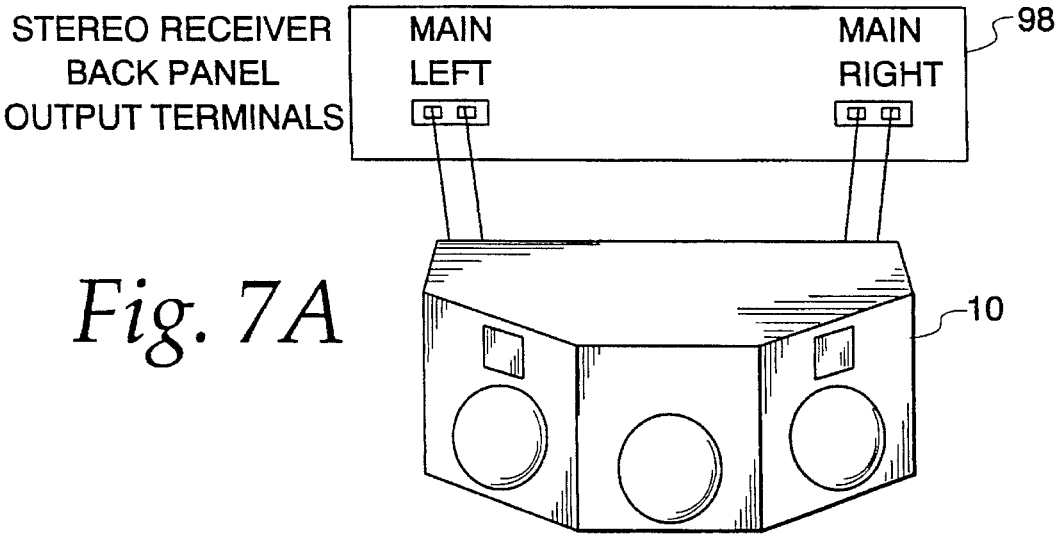
FIG. 7A shows the loudspeaker enclosure connected to conventional stereo outputs.
Figure 7B:
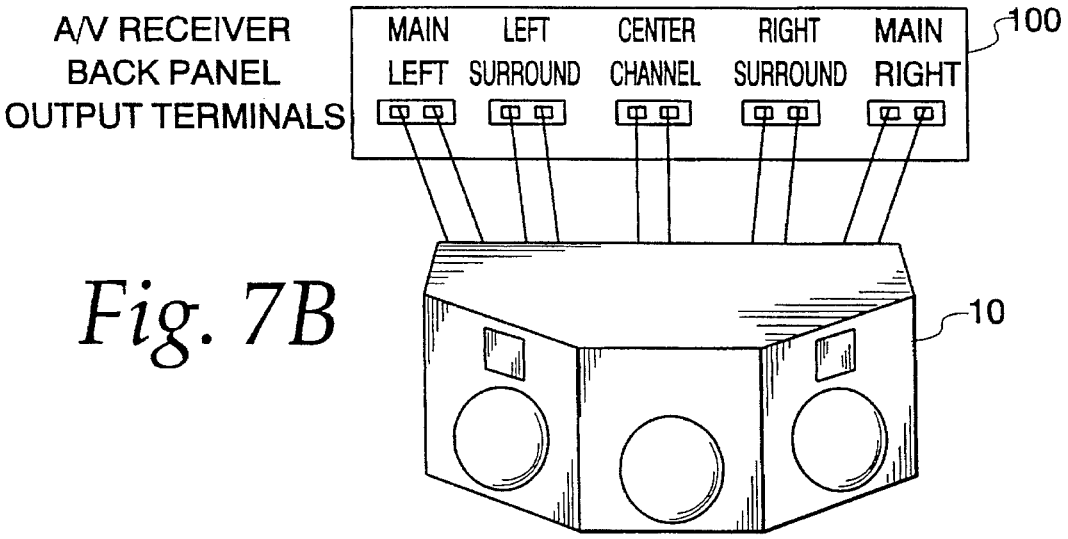
FIG. 7B shows the loudspeaker enclosure connected to conventional the five channel outputs from a surround sound receiver.
Figure 8A:
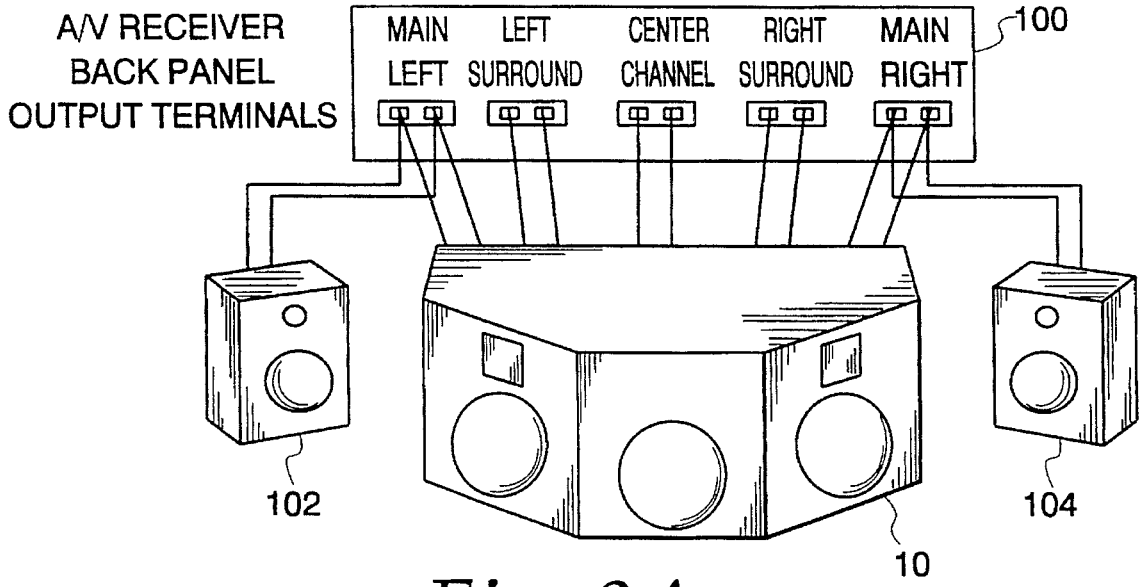
FIGS. 8A and 8B show alternative connections utilizing external loudspeakers with the unified loudspeaker enclosure in accordance with the present invention.
Figure 8B:
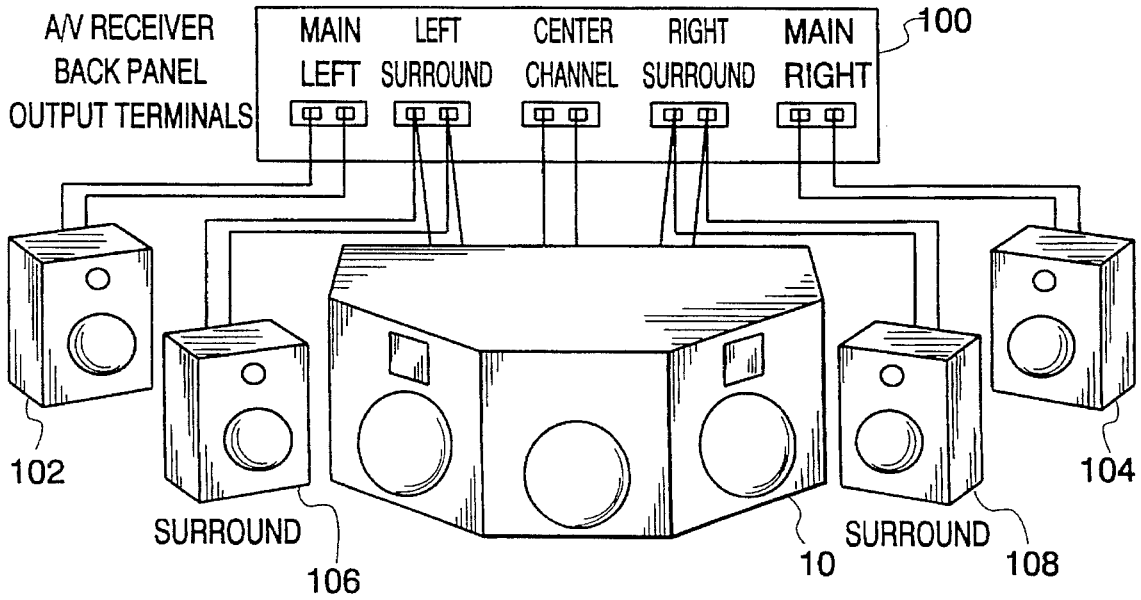

The satellite speakers of FIGS. 8A–B are added typically in alternative embodiments as shown. This increases the lateral dimensions for wide screens providing greater audience coverage. Controls for satellite speakers are part of the center soundstage speaker. The embodiment of FIGS. 7A–B using only the unified loudspeaker enclosure 10 may be driven either by standard stereo receiver back panel output terminals 98 or audio-visual (A/V) receiver back panel terminals 100 which are already equipped with five (5) channels for surround sound. FIGS. 8A–B illustrate the physical connection to an A/V receiver in embodiments utilizing satellite surround speakers to achieve greater coverage as discussed above.

It will be appreciated by those skilled in the art the modifications to the foregoing preferred embodiment may be made in various aspects. The present invention is set forth with particularity in the appended claims. It is deemed that the spirit and scope of that invention encompasses such modifications and alterations to the preferred embodiment as would be apparent to one of ordinary skill in the art and familiar with the teachings of the present application.

What is claimed is:

1. A multi-dimensional sound reproduction system housed in one or more speaker enclosures for creating multiple audio soundfields in a defined listening area responsive to a plurality of signals comprising:

a loudspeaker enclosure having a multiply-segmented face portion, said enclosure comprising, a centrally located binaural voice coil loudspeaker facing directly forward from the face portion of said enclosure into the defined listening area, a left-side located binaural voice coil loudspeaker, canted away from said centrally located loudspeaker, facing left of center forward from the face portion of said enclosure to provide left-side audio coverage of the defined listening area with audio channel separation from said centrally located loudspeaker, and a right-side located binaural voice coil loudspeaker, canted away from said centrally located loudspeaker, facing right of center forward from the face portion of said enclosure to provide right-side audio coverage of the defined listening area with audio channel separation from said centrally located loudspeaker; and a network for receiving, combining and delivering plural signals, said network comprising, means for receiving audio left channel signals including means for receiving left channel tweeter and left channel main signals, means for receiving audio right channel signals including means for receiving right channel tweeter and right channel main signals, means for deriving center channel signals from a combination of said received signals, delivering said derived center channel signals to the voice coils of the central loudspeaker, means for deriving a left surround effects channel from a combination of said received signals, delivering said received left and derived left surround effects channel signals to the voice coils of the left-side loudspeaker, said left surround effects deriving means comprises means for deriving an ambience left signal by subtracting the received right signal from the received left signal, and means for deriving a right surround effects channel signal from a combination of said received signals, delivering said received right and derived right surround effects channel signals to the voice coils of the right-side loudspeaker, said right surround effects deriving means comprises means for deriving an ambience right signal by subtracting the received left signal from the received right signal.

2. A system in accordance with claim 1 further comprising means for generating six (6) equalized soundfields defined as left, ambience left, center left, center right, ambience right and right soundfields via five (5) channels comprising said left, left surround effects, center, right surround effects and right channels.

3. A system in accordance with claim 2 wherein said enclosure is positionable atop a television receiver providing a unified home theater system improving spaciousness, directionality and 3-D imaging.

4. A system in accordance with claim 3 wherein said network further comprises means for receiving audio left surround, center and right surround channel signals from output terminals of a surround sound receiver.

5. A system in accordance with claim 4 further comprising terminals mounted on said enclosure providing signals for driving loudspeakers external to said enclosure.

6. A system in accordance with claim 5 wherein main left and main right channels are provided to loudspeakers separate and external to said enclosure for greater audio coverage of the defined area.

7. A system in accordance with claim 6 further comprising a subwoofer external to said enclosure for enhanced bass response.

8. A system in accordance with claim 7 wherein said receiving means of said network may receive signals from multiple sources including radio, television, audio reproduction, multimedia systems and the like.

9. A method of multi-dimensional sound reproduction for creating multiple audio soundfields in a defined listening area responsive to a plurality of signals, comprising the steps of:

providing a loudspeaker enclosure having a multiply-segmented face portion;

positioning a center binaural voice coil loudspeaker centrally, facing directly forward from the face portion of the enclosure into the defined listening area;

positioning left binaural voice coil loudspeaker left of the center loudspeakers and canted away therefrom, facing left of center forward from the face portion of the enclosure to provide left-side audio coverage of the defined listening area with audio channel separation from the center loudspeaker;

positioning a right binaural voice coil loudspeaker right of the center loudspeaker and canted away therefrom, facing right of center forward from the face portion of the enclosure to provide right-side audio coverage of the defined listening area with audio channel separation from the center loudspeaker;

receiving audio left channel signals including left channel tweeter and left channel main signals;

receiving audio right channel signals including right channel tweeter and right channel main signals;

deriving center channel signals from a combination of signals received in said receiving steps, delivering the derived center channel signals to the voice coils of the center provided loudspeaker;

deriving a left surround effects channel signal from a combination of signals received in said receiving steps, delivering the received left and the derived left surround effects channel signals to the voice coils of the left provided loudspeaker, said left surround effects deriving step comprising the step of deriving an ambience left signal by subtracting the received right signal from the received left signal; and deriving a right surround effects channel signal from a combination of signals received in said receiving steps, delivering the received right and the derived right surround effects channel signals to the voice coils of the right provided loudspeaker, said right surround effects deriving step comprising the step of deriving an ambience right signal by subtracting the received left signal from the received right signal.

* * * * *